United States Patent [19]

Polanco et al.

[11] Patent Number: 4,493,461

[45] Date of Patent: Jan. 15, 1985

[54] KITE REEL

[76] Inventors: Jose R. Polanco; George Spector, both of 3615 Woolworth Bldg., 233 Broadway, New York, N.Y. 10007

[21] Appl. No.: 503,283

[22] Filed: Jun. 10, 1983

[51] Int. Cl.[3] ..... B65H 75/40

[52] U.S. Cl. ..... 242/96; 242/99

[58] Field of Search ..... 242/96, 99, 68, 68.7, 242/75.4, 156, 156.2, 84.53

[56] References Cited

U.S. PATENT DOCUMENTS

| | | | |
|---|---|---|---|
| 274,490 | 3/1883 | Gunn | 242/96 |
| 279,190 | 6/1883 | Sager | 242/96 |
| 285,630 | 9/1883 | Kasschau | 242/96 |
| 797,300 | 8/1905 | Loxterman | 242/99 |
| 823,931 | 6/1906 | Connell | 242/96 |
| 1,067,643 | 7/1913 | Christner | 242/99 |
| 1,878,041 | 9/1932 | Voss | 242/99 |
| 2,692,093 | 10/1954 | Tengesdal | 242/96 |

*Primary Examiner*—Stuart S. Levy
*Assistant Examiner*—Lloyd D. Doigan

[57] ABSTRACT

A kite reel for controlling a line is provided and consists of a handle having a transverse aperture near top, an axle fixed at one end within the aperture of the handle, a spool rotatably mounted onto the axle, a knob for rotating the spool about the axis of the axle as the line is wound and unwound from the spool and a device for stopping rotation of the spool about the axis of the axle.

1 Claim, 5 Drawing Figures

KITE REEL

BACKGROUND OF THE INVENTION

The instant invention relates generally to reels and more specifically it relates to a kite reel for controlling a line.

There are many devices on the market for kite flying that are mechanically complex, expensive to purchase and bulky to use. This situation is not desirable and so accordingly is in need of an improvement.

SUMMARY OF THE INVENTION

A principle object of the present invention is to provide a kite reel that will simplify retrieving of the line.

Another object is to provide a kite reel made entirely of plastic that is lightweight and fool proof against electric shock.

An additional object is to provide a kite reel that can be made in various sizes to change line capacity.

A further object is to provide a kite reel that can be operated by nearly anyone and is easy to use.

A still further object is to provide a kite reel that is economical in cost to manufacture.

Further objects of the invention will appear as the description proceeds.

To the accomplishments of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
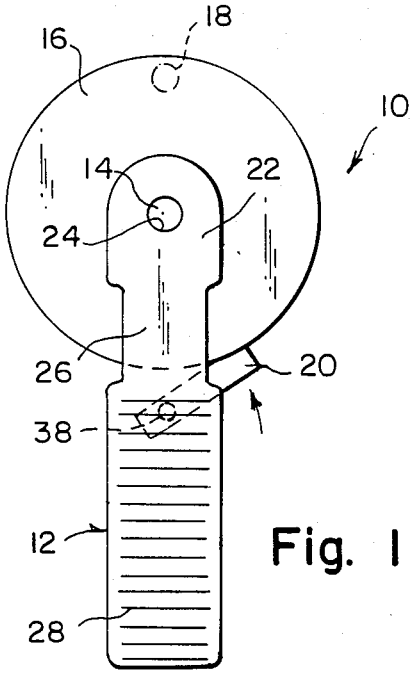
FIG. 1 is an end elevational view of the invention.
Figure 2:
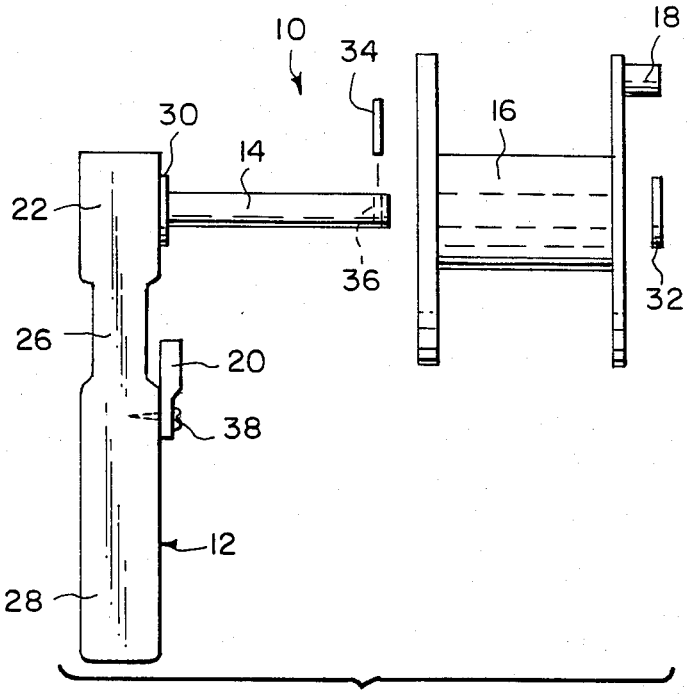
FIG. 2 is an exploded front elevational view.

Turning now descriptively to the drawings, in which similar reference characters denote similar elements throughout the several views, FIGS. 1 and 2 illustrates a kite reel 10. The reel 10 consists of a handle 12, an axle 14, a spool 16, a knob 18 and a brake arm 20.

The handle 12 has a top portion 22 that contains a transverse aperture 24, a narrow central portion 26 and a bottom portion 28 for hand grip. The axle 14 is fixed at one end within the aperture 24 of the handle 12. The spool 16 is rotatably mounted onto the axle 14 by utilizing two washers 30 and 32 placed on either side of the spool 16 and a pin 34 placed within an aperture 36 on free end of the axle 14 (see FIG. 2).

The knob 18 is mounted on the spool 16 opposite the handle 12 and off set from the axis of the axle 14 so that it can rotate the spool 16 about the axis of the axle 14 as the line (not shown) is wound and unwound from the spool 16.

The brake arm 20 is for stopping rotation of the spool 16 about the axis of the axle 14. The brake arm 20 is pivotally mounted by screw 38 on the bottom portion 28 of the handle 12 directly below the spool 16. The brake arm 20 can be pressed by a finger against the spool 16 from the right side and flipped over to be pressed by a finger against the spool 16 from the left side.

Figure 3:
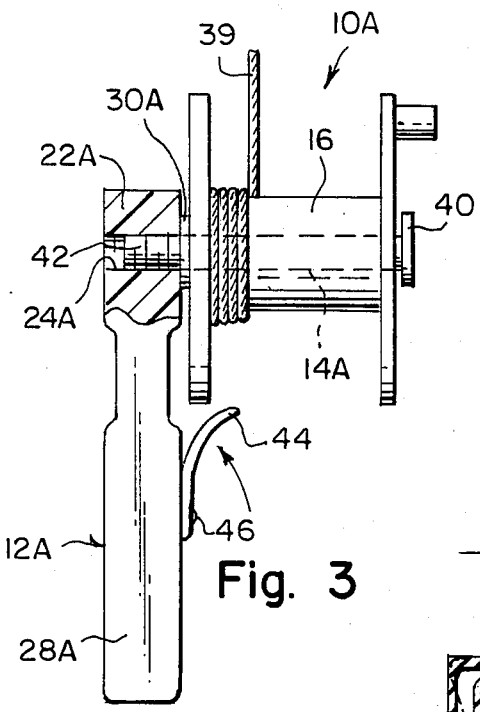
FIG. 3 is a front elevational view partly in section of a modification of the invention.

FIG. 3 shows a modified kite reel 10A for controlling a line 39. The spool 16 is rotatably mounted onto the axle 14A by utilizing a washer 30A placed between the spool 16 and the handle 12A. The axle 14A has a flat head 40 on free end and threads 42 on other end that threadably engages a threaded transverse aperture 24A near the top 22A of the handle 12.

A flexible brake member 44 for stopping rotation of the spool 16 is mounted by a rivet 46 on the bottom portion 28A of the handle 12A directly below the spool 16. The brake member 44 can be pressed by a finger against the spool 16.

Figure 4:
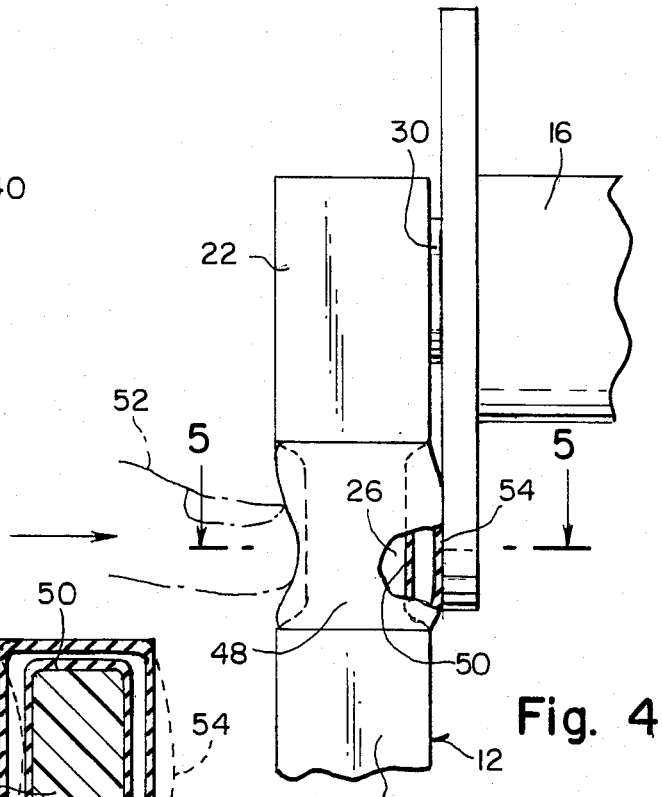
FIG. 4 is a partial front elevational view of another modification of the invention.
Figure 5:
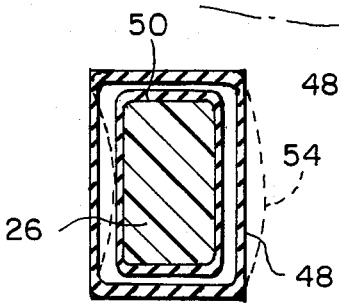
FIG. 5 is a cross sectional view taken along line 5—5 in FIG. 4.

FIGS. 4 and 5 shows another way of stopping rotation of the spool 16. An elastic air bag 48 is mounted around a reduced circumference 50 of the narrow central portion 26 of the handle 12 near the spool 16. When the elastic air bag 48 is pressed by a finger 52 it will bulge out at 54 to bear against the spool 16.

The kite reel 10 can be made out of plastic, wood or any other lightweight insulated material to prevent electric shock from lightening. Because of simplicity, ease of handling and the ease of installing additional spools with lines of different strength or quality the user of the kite reel 10 will want to own more than one of the inexpensive spools 16.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A kite reel for controlling a line which comprises:

(a) a handle having a transverse aperture near top;

(b) an axle at one end within the aperture of the handle;

(c) a spool rotatably mounted onto the axle;

(d) means for rotating the spool about the axis of the axle as the line is wound and unwound from the spool; and (e) means for stopping rotation of the spool about axis of the axle wherein said means comprises an elastic bag mounted around a reduced circumference of the handle near the spool so that when the elastic bag is pressed by a finger it will bulge out to bear against the spool.

* * * * *